United States Patent [19]

Thesenfitz

[11] Patent Number: 4,555,283

[45] Date of Patent: Nov. 26, 1985

[54] METHOD OF FORMING A STORAGE TANK FOR BITUMEN IN THE LIQUID STATE

[75] Inventor: Klaus Thesenfitz, Winsen, Fed. Rep. of Germany

[73] Assignee: Linhoff & Thesenfitz Maschinenbau GmbH, Winsen, Fed. Rep. of Germany

[21] Appl. No.: 443,510

[22] Filed: Nov. 22, 1982

[30] Foreign Application Priority Data

May 14, 1982 [DE] Fed. Rep. of Germany ..... 3218135
Jul. 2, 1982 [DE] Fed. Rep. of Germany ..... 3224869

[51] Int. Cl.[4] ..... E04B 2/20

[52] U.S. Cl. ..... 156/71; 52/249; 52/268; 52/389; 52/743; 156/305; 156/337; 220/1 B; 220/5 A; 220/218; 220/453

[58] Field of Search ..... 220/1 B, 468, 5 A, 218, 220/216, 453; 156/305, 337, 71; 52/746, 743, 245, 249, 247, 267, 268, 269, 389, 390, 593, 595, 744; 428/312.6, 312.4, 208.4, 489

[56] References Cited

U.S. PATENT DOCUMENTS

| | | | |
|---|---|---|---|
| 528,399 | 10/1894 | Stebbins | 52/249 X |
| 609,733 | 8/1898 | Coker, Jr. | 52/249 X |
| 1,120,108 | 12/1914 | Warwick | 52/249 |
| 1,888,039 | 11/1932 | Huff | 52/245 X |
| 1,931,525 | 10/1933 | Boardman | 220/216 |
| 2,054,587 | 9/1936 | Neuhans | 52/268 X |
| 2,227,228 | 12/1940 | Payne | 52/268 X |
| 2,306,556 | 12/1942 | Neuhans | 52/268 X |
| 2,580,519 | 1/1952 | Cope | 52/389 |
| 2,827,397 | 3/1958 | Affleck | 428/312.4 X |
| 3,330,627 | 7/1967 | McCormick | 428/312.6 X |
| 3,372,083 | 3/1968 | Evans | 156/337 X |
| 3,401,818 | 9/1968 | Hasen | 220/218 X |
| 3,473,689 | 10/1969 | Hutter | 52/247 |
| 3,576,700 | 4/1971 | Dell | 156/337 X |
| 3,998,204 | 12/1976 | Fuchs et al. | 220/218 X |
| 4,155,787 | 5/1979 | DeSadier | 156/337 X |

*Primary Examiner*—Allan N. Shoap
*Attorney, Agent, or Firm*—Alan H. Levine

[57] ABSTRACT

A storage tank for liquid bitumen including a steel shell having heat insulation adjacent to its interior surface. The insulation is glass foam. Preferably, the insulation is in the form of glass foam panels which are initially arranged with gaps between them. When the tank is filled for the first time, the liquid bitumen penetrates into the gaps and solidifies therein to permanently interconnect the glass foam panels. A glass foam insulating cover floats on the surface of the liquid bitumen, and a heating unit is located within the tank.

16 Claims, 7 Drawing Figures

METHOD OF FORMING A STORAGE TANK FOR BITUMEN IN THE LIQUID STATE

Insulated storage tanks of steel are used for storing bitumen. The insulation is usually applied to the outside of the tank. For various reasons, however, insulation on the inside of the tank would be desirable.

It is, therefore, an object of the present invention to provide an insulation which can be applied to the inside of a tank. Glass sponge has been found to be a suitable material for this purpose.

Accordingly, the invention relates to a steel storage tank for liquid bitumen, wherein heat insulation of glass sponge is applied to the interior surface of the tank. A tank, provided with an internal insulation of this type, is resistant to temperatures into the region above 200° C., so that the liquid bitumen at temperatures between 160° and 220° C. can be stored in it over a long period of time.

The advantage of such a storage tank over known storage tanks with external insulation stems from the fact that less energy is required for heating, because the steel wall of the tank does not have to be heated, in addition to the fact that it does not radiate heat. Moreover, no heat transmission bridges develop to the supporting structure of the tank, nor is any heat drained away to the foundations. Finally, the insulation is protected against damage due to mechanical or weathering effects.

The tank may be coated with glass sponge on the entirety of its inside surface, or individual panels can be coated with glass sponge and such panels then assembled together to form the tank, or a particularly advantageous process can be employed like the one described in detail below.

Additional objects and advantages of the invention will be apparent from the following description, in which reference is made to the accompanying drawings. In the drawings:

FIG. 6 is a fragmentary cross-sectional view of the tank wall on an enlarged scale, showing another embodiment of the tank and insulation; and FIG. 7 is a view similar to FIG. 6 showing another embodiment of the insulation.

Figure 1:
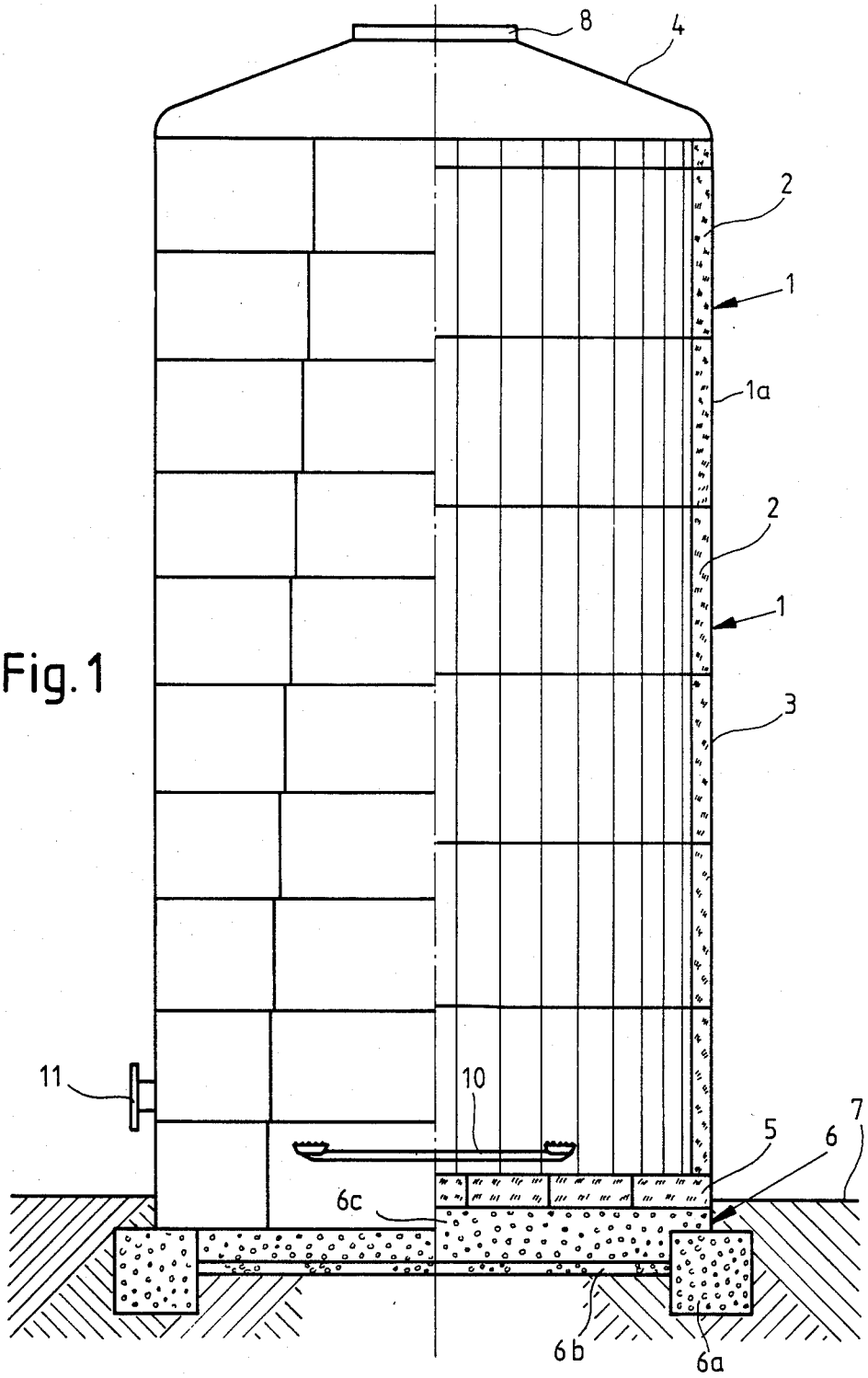
FIG. 1 is a schematic view, partially in elevation and partially in longitudial cross-section, of a storage tank for liquid bitumen according the present invention.

The shell of the tank 1 is assembled of individual panels 1*a*. Each panel consists of an external panel, preferably of a steel core and a ceramic coating which, in a first embodiment is coated on the internal surface with glass sponge 2. The individual panels are assembled to form the shell, which consists of the cylindrical side wall 3, the roof 4, and the base 5. All parts 3, 4 and 5 of the tank consist of panels coated with glass sponge. The storage tank is supported on a foundation 6.

Preferably, the tank is erected in situ on the foundations in accordance with a second, particularly advantageous, embodiment using exterior panels 1*a* which are still uncoated. As in the case of the first embodiment described above, the exterior panels consist of a steel core coated all around with ceramic, which have not yet been coated with glass sponge. The foundation comprises a ring-shaped foundation 6*a*, whose interior region is filled with a thin foundation panel 6*b*, which has no supporting function in respect to the tank. The difference in height between the foundation panel 6*b* and the level 7 of the ground surrounding the tank is evened up with lean concrete 6*c*. The exterior wall of the tank, which is supported on the foundation ring 6*a*, is assembled from individual panels 1 and is self-supporting or supported by an external scaffolding, which in turn is supported on the foundation ring 6*a*.

Figure 2:
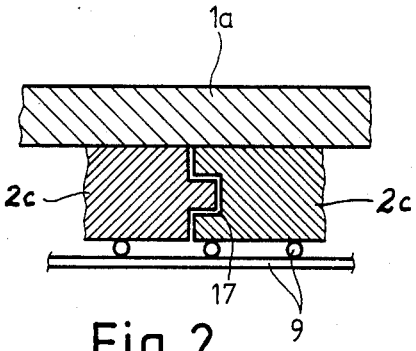
FIG. 2 is a fragmentary cross-sectional view of the tank wall on an enlarged scale, showing one embodiment of the insulation.
Figure 3:
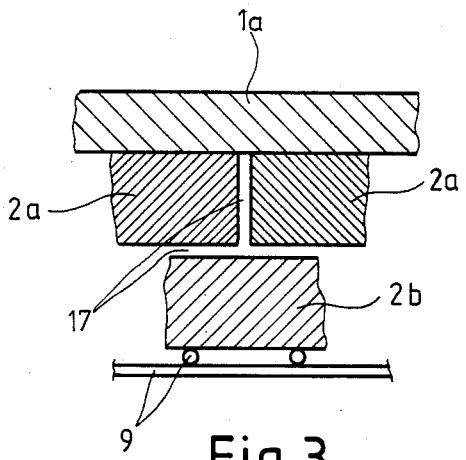
FIG. 3 is a view similar to FIG. 2 showing another embodiment of the insulation.

The inner surface of the tank shell, formed in this manner, is now lined with glass-foam panels (FIGS. 1–3). Individual glass-foam panels 2*c* interlock in tongue-and-groove fashion (see FIG. 2), or lie next to and on top of each other like brickwork so that the gaps between panels 2*a*, lying against the tank wall, are covered by internal panels 2*b* (see FIG. 3). In either case, labyrinth gaps 17 are formed which, deliberately and for reasons to be explained below, must have a certain minimum width, but in any case are not avoided completely. As used herein, the term "labyrinth" is intended to mean that each gap 17 has a non-linear shape from one of its ends to the other, as indicated in FIGS. 2 and 3. The individual panels, therefore, lie loosely against, and possibly over, each other, as well as against the shell 1 of the tank. In order to prevent collapse of the tank insulation in this condition, the tank insulation is arranged between the wall of the tank shell and an inserted wire netting 9. The insulation of the side wall and the base is built up in corresponding manner. The wire netting can be omitted for the insulation of the base.

A heating device 10 (FIG. 1), which is mounted within the tank in the region of its base and which can be of any conventional design, is used to heat the liquid bitumen, which is still introduced into the tank later on for storage.

Once the storage tank has been constructed as far as described above, it can be filled for the first time with liquid bitumen. Filling is accomplished through an inlet 8 at the upper end of the tank, which can be closed. On filling the tank with liquid bitumen, the latter penetrates into the labryinth gaps 17 between the individual insulation panels, possibly reaching the region of the tank shell. Since the temperature in the tank filled with bitumen is of the order of 200° C., while the maximum outside temperature during the construction period realistically will not be higher than 24° C., the bitumen cools down on its way through the labyrinth to solidify in the region of the labyrinth near the shell wall. When the tank is emptied through an outlet 11 at the lower end of the tank, the bitumen has solidified in the labyrinths; therefore, at most, it drains out of the inner regions of the labyrinth channels. The next time the tank is filled with liquid bitumen, the bitumen, which has remained behind in the labyrinth channels, softens somewhat but essentially remains rigid within the labyrinth channels 17. In this simple manner, the tank insulation is sealed reliably; at the same time, the individual insulation panels are connected to each other and the internal seal between them becomes a durable, stable seal, which remains stable even if the wire insert 9 should become brittle in the course of time and be no longer able to function.

A reduced, through similar, effect arises in the region of the panels themselves. Foam glass is formed from blown, very small glass tubes, which are ground and fused. The insulation panels therefore have a rough surface presenting end cross sections of glass tubes, lying irregularly next to each other. When the tank is filled for the first time, liquid bitumen penetrates into the tube sections which initially are open to the outside and, by so doing, may even cause the walls of the tubes to soften somewhat. A uniformly smooth inner side of the actual insulating layer is formed opposite the liquid bitumen. As the tank is emptied, a smooth solidifying insulating surface layer remains behind above the falling bitumen level. The layer will possibly soften somewhat on the outside when the tank is filled once again, but it is smooth and solid when the tank is empty. This is useful in respect to protecting the insulation against inadvertent damage, when work is occasionally carried out inside the empty tank. It also makes occasional cleaning work easier. This is a significant advantage of the invention, in addition to the advantage of saving considerable energy.

Figure 4:
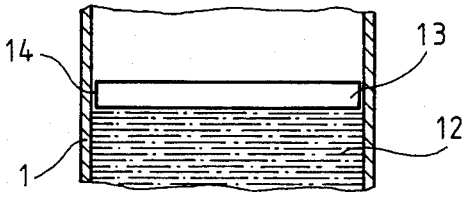
FIG. 4 is a fragmentary longitudial cross-sectional view, on a reduced scale, showing a cover for the bitumen.

With respect to saving energy, a heat-insulating cover immediately over the surface of the liquid bitumen 12 (FIG. 4) in the tank and independent of the amount of bitumen in the tank, is also of advantage. For this purpose, a disk 13 of foam glass, floating on the bitumen, is useful, between the outer circumference of which and the inner circumference of the tank there is as narrow a gap 14 as possible, which is just sufficient for permitting the necessary vertical movements of the disk. Owing to the densities of bitumen and foam glass, the foam glass disk floats well on the liquid bitumen.

Figure 5:
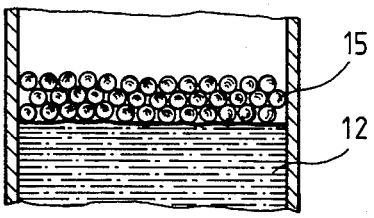
FIG. 5 is a view similar to FIG. 4 showing another embodiment of the cover.

A particularly useful solution to the problem of covering the bitumen 12 in the tank is accomplished by adding a large number of regular or irregular spheres 15 (FIG. 5) of foam glass to the tank, to take the place of the homogeneous disk 13. As the liquid bitumen 12 rises in the tank during the filling operation, the glass foam spheres spread over the surface of the bitumen to form a layer, whose thickness depends on the number and volume of the spheres. The spheres provide heat insulation at the top in a form which is simple, reliable, and of practically unlimited durability. If a few spheres actually wear, their replacement presents no problem. The bitumen in the tank is therefore surrounded directly and on all sides by an excellent insulating layer, so that the heat losses which occur are extremely small and can be compensated for by the heating device 10, which is mounted within the insulating shell. Bitumen can be stored in this manner over extremely long periods of time with extremely small expenditures of energy. Moreover, the tank can be erected easily and inexpensively.

In summary, the storage tank of this invention, for bitumen in the liquid state, can be described once again as follows: the invention relates to a container for receiving and occasionally storing liquid bitumen. By means of the insulating material, it is possible to apply the necessary insulation to the interior surface of the container. By so doing, it is possible to maintain the necessary temperature with a small expenditure of energy.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of fabricating a storage tank for liquid bitumen comprising the steps of:

assembling a steel shell of individual steel panels to surround a liquid bitumen holding volume, inserting glass foam panels into the shell, adjacent to the interior surface of the shell, and leaving labyrinthian gaps between the individual panels, leaving the gaps empty of any material during fabrication of the storage tank, and filling the holding volume with liquid bitumen so that the latter fills the gaps and solidifies therein to permanently interconnect the glass foam panels to thereby form a wall layer to contain the remaining liquid bitumen within said holding volume.

2. A method as defined in claim 1 wherein the glass foam panels are formed with cooperating tongues and grooves which define between them the labyrinth gaps.

3. A method as defined in claim 1 wherein the layer of glass foam panels is directly adjacent to the steel shell, the panels being separated by gaps, and providing a second layer of glass foam panels inwardly of the first layer, the panels of the second layer overlying the gaps in the first layer.

4. A method as defined in claim 1 including providing a base for the steel shell, and lining the base with glass foam.

5. A method as defined in claim 1 including providing a foam glass cover for the bitumen in the tank.

6. A method as defined in claim 5 wherein the cover is a disk floating on the surface of the bitumen.

7. A method as defined in claim 5 wherein the cover is a mass of foam glass spheres floating on the surface of the bitumen.

8. A method as defined in claim 1 including providing a heating unit within the tank.

9. A method of fabricating a storage tank for liquid bitumen comprising the steps of:

providing a plurality of individual steel panels, each steel panel having a glass foam panel on one of its surfaces, assembling the steel panels to form a shell to surround a liquid bitumen holding volume, the glass foam panels being located on the interior faces of the steel panels and there being labyrinthian gaps between the glass foam panels, leaving the gaps empty of any material during fabrication of the storage tank, and filling the holding volume with liquid bitumen so that the latter fills the gaps and solidifies therein to permanently interconnect the glass foam panels to thereby form a wall layer to contain the remaining liquid bitumen within said holding volume.

10. A method as defined in claim 9 wherein the glass foam panels are formed with cooperating tongues and grooves which define between them the labyrinth gaps.

11. A method as defined in claim 9 wherein the layer of glass foam panels is directly adjacent to the steel shell, the panels being separated by gaps, and providing a second layer of glass foam panels inwardly of the first layer, the panels of the second layer overlying the gaps in the first layer.

12. A method as defined in claim 9 including providing a base for the steel shell, and lining the base with glass foam.

13. A method as defined in claim 9 including providing a foam glass cover for the bitumen in the tank.

14. A method as defined in claim 13 wherein the cover is a disk floating on the surface of the bitumen.

15. A method as defined in claim 13 wherein the cover is a mass of foam glass spheres floating on the surface of the bitumen.

16. A method as defined in claim 9 including providing a heating unit within the tank.

* * * * *